US009426594B2

(12) United States Patent
Cai et al.

(10) Patent No.: US 9,426,594 B2
(45) Date of Patent: Aug. 23, 2016

(54) MINIATURE SPEAKER

(71) Applicants: Bin Cai, Shenzhen (CN); Yunxia Xu, Shenzhen (CN)

(72) Inventors: Bin Cai, Shenzhen (CN); Yunxia Xu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 78 days.

(21) Appl. No.: 14/305,029

(22) Filed: Jun. 16, 2014

(65) Prior Publication Data

US 2015/0365744 A1 Dec. 17, 2015

(30) Foreign Application Priority Data

Dec. 11, 2013 (CN) ..... 2013 2 0816496 U

(51) Int. Cl.
*H04R 31/00* (2006.01)
*H04R 1/02* (2006.01)
*H04R 9/06* (2006.01)

(52) U.S. Cl.
CPC ..... *H04R 31/006* (2013.01); *H04R 1/023* (2013.01); *H04R 9/06* (2013.01); *H04R 2499/11* (2013.01)

(58) Field of Classification Search
CPC ... H04R 2400/11; H04R 31/006; H04R 1/023
See application file for complete search history.

(56) References Cited

U.S. PATENT DOCUMENTS

| | | | | |
|---|---|---|---|---|
| 4,081,626 | A * | 3/1978 | Muggli | G01H 11/06 367/140 |
| 7,200,241 | B2 * | 4/2007 | Fukuyama | H04R 1/06 381/407 |
| 2001/0045321 | A1 * | 11/2001 | Sugiyama | H04R 9/06 181/161 |
| 2009/0142961 | A1 * | 6/2009 | Chen | H01R 12/7076 439/626 |
| 2009/0304223 | A1 * | 12/2009 | Chang | H04R 31/006 381/412 |
| 2012/0109029 | A1 * | 5/2012 | Ma | H04R 11/02 601/46 |
| 2012/0170791 | A1 * | 7/2012 | Meng | H04R 9/02 381/386 |
| 2013/0016874 | A1 * | 1/2013 | Huang | H04R 9/043 381/433 |
| 2014/0056445 | A1 * | 2/2014 | Li | H04R 1/00 381/152 |
| 2014/0270304 | A1 * | 9/2014 | Pieklik | H04R 1/023 381/334 |
| 2015/0201256 | A1 * | 7/2015 | Xu | H04R 1/06 381/417 |

* cited by examiner

*Primary Examiner* — Matthew Eason
(74) *Attorney, Agent, or Firm* — IPro, PLLC; Na Xu; Qian Gu

(57) ABSTRACT

A miniature speaker is disclosed. The miniature speaker includes a frame providing a receiving space, a magnetic circuit accommodated in the receiving space, a voice coil, a membrane activated by the voice coil for generating sounds, a number of contacts for electrically connected to the voice coil, and a front cover for fixing the membrane to the frame. The front cover includes an outer ring and a top cover coupled with the outer ring. The top cover includes a step engaging with the outer ring. By virtue of the configuration of the front cover, the assembling precision of the outer ring and the top cover is ensured, and the thicknesses of the outer ring and the top cover are maintained for providing sufficient strength.

9 Claims, 3 Drawing Sheets

MINIATURE SPEAKER

FIELD OF THE INVENTION

The present invention relates to electro-acoustic transducers, more particularly to a miniature speaker having a front cover with sufficient strength.

DESCRIPTION OF RELATED ART

With the rapid development of wireless communication technologies, mobile phones are widely used. Users require mobile phones to not only have voice function, but also have high quality acoustic performance. A mobile phone also provides the user with entertainment contents, such as music, video, game. For converting electrical signals to audible sounds, a speaker is a necessary component used in a mobile phone for generating sounds. As the mobile phone is designed to be smaller and smaller, the speaker used therein is also required to have a low profile with small size.

Generally, a miniature speaker related to the present disclosure electrically connects to external circuits via elastic contacts for converting electrical signals to audible sounds. Such a miniature speaker includes a frame, a sound generator accommodated in the frame, and a front cover assembled with the frame for protecting the sound generator. The sound generator includes a membrane and a voice coil connected to the membrane. While electrified, the voice coil activates the membrane to vibrate, thus audible sounds are generated. Typically, the front cover includes a gasket pressing an edge of the membrane for fixing the membrane to the frame, and a top cover mounted on the gasket. As mentioned above, the speaker is designed to be smaller and smaller; each of the gasket and the top cover has a small size and has poor strength. Due to the poor strength of the front cover, the gasket or the top cover is easily to be deformed or even broken during assembling process, which seriously affects the acoustic performance of the miniature speaker.

Accordingly, an improved miniature speaker which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment.

Figure 1:
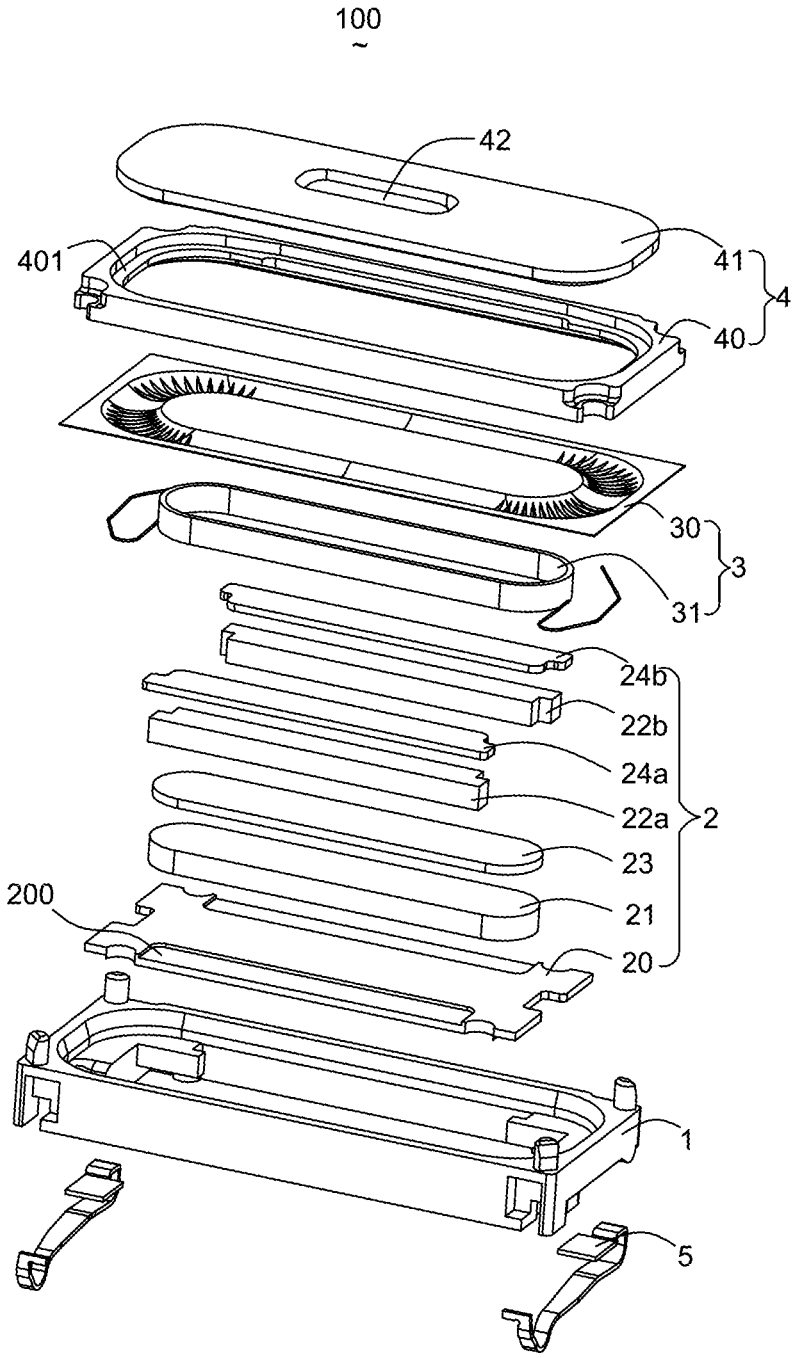
FIG. 1 is an isometric exploded view of a miniature speaker in accordance with an exemplary embodiment of the present disclosure.

Referring to FIG. 1, a miniature speaker 100 in accordance with an exemplary embodiment of the present disclosure comprises a frame 1 providing a receiving space, a magnetic circuit 2 accommodated in the receiving space, a vibration unit 3 fixed to the frame 1, and a front cover 4 coupled to the vibration unit 3. The vibration unit 3 includes a membrane 30 and a voice coil 31 connected to the membrane 30 for driving the membrane 30 to vibrate, which produces audible sounds. The voice coil 13 electrically connects to an external circuit (not shown) via a plurality of contacts 5 for receiving electrical signals from the external circuit.

Figure 2:
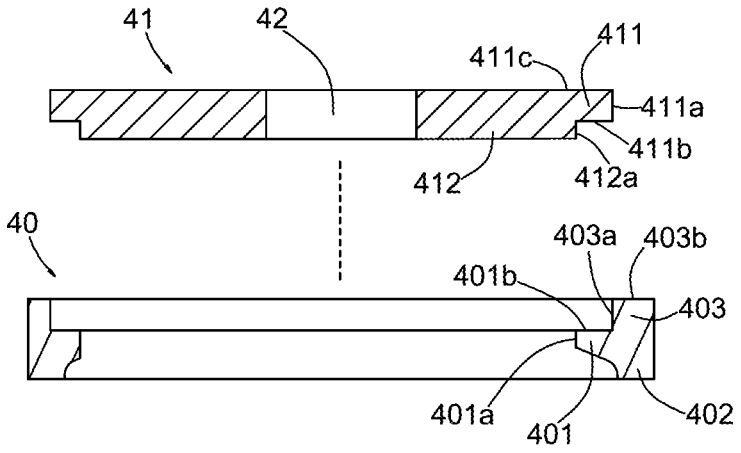
FIG. 2 is a cross-sectional view of a front cover of the miniature speaker in FIG. 1, wherein an outer ring is ready to be coupled to a top cover.

Referring to FIG. 2, the front cover 4 further includes an outer ring 40 and a top cover 41 coupled with the outer ring 40. The outer ring 40 includes a sidewall and a protrusion 401 extending from an inner surface of the sidewall toward a center of the outer ring 40. Due to the protrusion 401, the sidewall is divided into a pressing portion 402 and a position portion 403. The protrusion 401 comprises a first inner side 401*a* and a first top side 401*b*. The position portion 403 comprises a second inner side 403*a*, and a second top side 403*b*. The first top side 401*b* is relatively lower than the second top side 403*b*. The first inner side 401*a* is relatively closer to the center of the outer ring 40 than the second inner side 403*a*. The top cover 41 includes a main body 411 and an extending portion extending from a middle portion of the main body 411 toward the outer ring 40, thereby forming a step corresponding to the protrusion 401 of the outer ring 41. The main body 411 includes a first outer side 411*a* corresponding to the second inner side 403*a*, a first lower side 411*b* corresponding to the first top surface 401*b*, and a top surface 411*c*. The extending portion 412 includes a second outer side 412*a* corresponding to the first inner side 401*a*.

Figure 4:
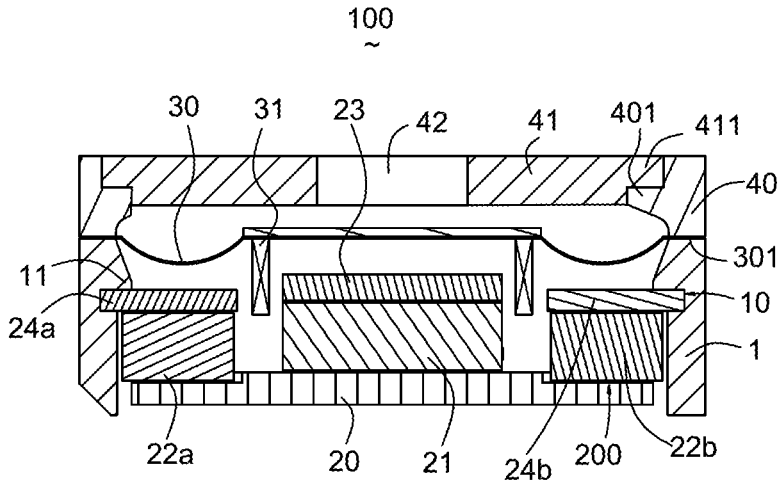
FIG. 4 is a cross-sectional view of the miniature speaker in FIG. 1.

Referring to FIG. 2, together with FIG. 4, while assembled, the main body 411 of the top cover 41 engages with the protrusion 401 of the outer ring 40, with the first lower side 411*b* abutting against the first top side 401*b*, the first outer side 411*a* abutting against the second inner side 403*a*, and the second outer side 412*a* abutting against the first inner side 401*a*. Thus, the top cover 41 is integrated with the outer ring 40 firmly. Optionally, the top surface 411*c* is coplanar with the second top side 403*b*. For transmitting the sound generated by the vibration unit, the top cover 41 further includes a sound aperture 42 through the main body 411 and the extending portion 412.

Figure 3:
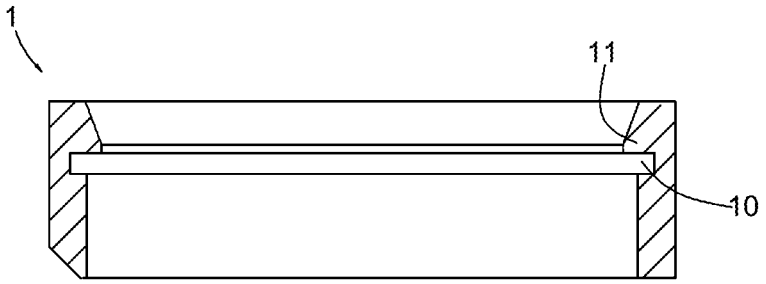
FIG. 3 is a cross-sectional view of a frame of the miniature speaker in FIG. 1.

Referring to FIG. 3, the frame 1 is provided with a projecting portion 11 and a slot 10. Referring to FIG. 4, together with FIG. 3, the magnetic circuit 2 comprises a magnetic gap for partially receiving the voice coil 31. The magnetic circuit 2 comprises a lower plate 20, a first magnet 21 positioned on a central portion of the lower plate 20, a first pole plate 23 attached on a top of the first magnet 21, a second magnet 22*a* positioned on the lower plate 20 separated from the first magnet 21, a second pole plate 24*a* attached on a top of the second magnet 22*a*, a third magnet 22*b* positioned on the lower plate 20 away from the second magnet 22*a*, and a third pole plate 24*b* attached on a top of the third magnet 22*b*. While assembled, the first magnet 21 locates on the lower plate 20 between the second magnet 22*a* and the third magnet 22*b*. The lower plate 20 further includes a pair of recesses 200 for positioning the second and third magnets 22*a*, 22*b*. When the voice coil 31 is electrified, the voice coil 31 is activated to vibrate due to the Lorenz Force generated by the magnetic circuit 2. Accordingly, the membrane 30 is driven by the voice coil 31 to vibrate, and sounds are thus produced. Optionally, the second pole plate 24*a* and the third pole plate 24*b* are partially received in the slot 10 of the frame 1, and the projecting portion 11 abuts against tops of the second pole plate

24*a* and the third pole plate 24*b*. By virtue of this configuration, the magnetic circuit 2 is firmly positioned by the frame 1. The pressing portion 402 of the front cover 4 presses on an edge of the membrane 30 for fixing the membrane 30 to the frame 1.

By virtue of the configuration of the front cover as described above, the assembling precision of the outer ring and the top cover is ensured, and the thicknesses of the outer ring and the top cover are maintained for providing sufficient strength.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A miniature speaker, comprising:

a frame providing a receiving space;

a magnetic circuit accommodated in the receiving space, the magnetic circuit further forming a magnetic gap;

a voice coil including a distal end suspended in the magnetic gap;

a membrane activated by the voice coil for generating sounds;

a plurality of contacts fixed by the frame for electrically connected to the voice coil;

a front cover for fixing the membrane to the frame, the front cover including an outer ring and a top cover coupled with the outer ring, the top cover including a step engaging with the outer ring;

wherein, the frame includes a projecting portion abutting against a top of the magnetic circuit and a slot for partially receiving the magnetic circuit;

the magnetic circuit comprises a lower plate, a first magnet positioned on a central portion of the lower plate, a first pole plate attached on a top of the first magnet, a second magnet positioned on the lower plate separated from the first magnet, a second pole plate attached on a top of the second magnet, a third magnet positioned on the lower plate away from the second magnet, and a third pole plate attached on a top of the third magnet.

2. The miniature speaker as described in claim 1, wherein the outer ring includes a sidewall and a protrusion extending from an inner surface of the sidewall toward a center of the outer ring for dividing the sidewall into a pressing portion pressing on the membrane and a position portion fixing the top cover.

3. The miniature speaker as described in claim 2, wherein the protrusion comprises a first inner side and a first top side, the position portion comprises a second inner side, and a second top side, the first top side being relatively lower than the second top side, and the first inner side being relatively closer to the center of the outer ring than the second inner side.

4. The miniature speaker as described in claim 3, wherein the top cover includes a main body and an extending portion extending from a middle portion of the main body toward the outer ring, thereby forming the step corresponding to the protrusion of the outer ring.

5. The miniature speaker as described in claim 4, wherein the main body includes a first outer side corresponding to the second inner side, a first lower side corresponding to the first top surface, and the extending portion includes a second outer side corresponding to the first inner side.

6. The miniature speaker as described in claim 5, wherein the main body further includes a top surface coplanar with the second top side of the outer ring.

7. The miniature speaker as described in claim 6, wherein the main body of the top cover engages with the protrusion of the outer ring, with the first lower side abutting against the first top side, the first outer side abutting against the second inner side, and the second outer side abutting against the first inner side.

8. The miniature speaker as described in claim 1, wherein the lower plate includes a pair of recesses for positioning the second and third magnets.

9. The miniature speaker as described in claim 8, wherein the second pole plate and the third pole plate are partially received in the slot of the frame, and the projecting portion abuts against tops of the second pole plate and the third pole plate.

* * * * *